United States Patent [19]

Filippi

[11] Patent Number: 4,972,997

[45] Date of Patent: Nov. 27, 1990

[54] ELECTROMAGNETICALLY-CONTROLLED FUEL INJECTION VALVE FOR I.C. ENGINES

[76] Inventor: Renato Filippi, Via Parisetto 31, 10048 Vinovo (Torino), Italy

[21] Appl. No.: 236,668

[22] Filed: Aug. 25, 1988

[30] Foreign Application Priority Data

Aug. 25, 1987 [IT] Italy ..... 53610/87[U]

[51] Int. Cl.[5] ..... F02M 39/00

[52] U.S. Cl. ..... 239/585; 239/533.8; 123/458; 123/459

[58] Field of Search ..... 239/585, 533.2–533.12; 251/30.01, 30.05; 123/458, 459, 514

[56] References Cited

U.S. PATENT DOCUMENTS

| | | | |
|---|---|---|---|
| 3,464,627 | 9/1969 | Huber | 239/585 |
| 3,921,604 | 11/1975 | Links | 123/458 |
| 4,482,094 | 11/1984 | Knape | 239/585 |
| 4,566,416 | 1/1986 | Berchtold | 239/585 |
| 4,584,980 | 4/1986 | Weiger et al. | 251/30.01 |
| 4,605,166 | 8/1986 | Kelly | 239/585 |
| 4,722,312 | 2/1988 | Yamada et al. | 251/30.01 |

FOREIGN PATENT DOCUMENTS

| | | | |
|---|---|---|---|
| 0196265 | 10/1986 | European Pat. Off. . | |
| 0228578 | 7/1987 | European Pat. Off. . | |
| 1933489 | 3/1970 | Fed. Rep. of Germany | 239/585 |
| 3227742 | 5/1983 | Fed. Rep. of Germany . | |
| 0434875 | 10/1967 | Switzerland . | |
| 2185530 | 7/1987 | United Kingdom . | |
| 82/03108 | 9/1982 | World Int. Prop. O. . | |

*Primary Examiner*—Andres Kashnikow
*Assistant Examiner*—Christopher G. Trainor
*Attorney, Agent, or Firm*—Dvorak and Traub

[57] ABSTRACT

An electromagnetically-controlled fuel injection valve (1) for i.c. engines includes a body (2) carrying an upper electromagnetic metering valve (10) which controls communication between a control chamber (9), to which the fuel is fed under pressure through an inlet hole (Z) to keep the associated injector needle (4) in the closed position, and a discharge hole (A) for controlling the opening of the needle (4). The solenoid valve (10) with the control chamber (9), the inlet hole (Z) and the discharge hole (A) are integrated in a single element forming a head (13) for the body (2) of the injection valve (1).

1 Claim, 1 Drawing Sheet

ELECTROMAGNETICALLY-CONTROLLED FUEL INJECTION VALVE FOR I.C. ENGINES

The present invention relates to electromagnetically-controlled fuel-injection valves in general for i.c. engines, particularly diesel engines.

More particularly, the invention relates to an injection valve of the type comprising a body having a lower injection nozzle with which is operatively associated a needle controlling communication between the nozzle and an injection chamber which communicates with a passage for the supply of fuel under pressure, and an upper electromagnetic metering valve which controls the communication between a control chamber, to which the fuel is supplied under pressure through an inlet hole to keep the needle in the closed position, and a discharge hole the opening of which causes a pressure drop in the control chamber and the consequent opening of the needle.

In known injection valves of the type defined above, the body of the metering solenoid valve, the control chamber, the inlet hole and the discharge hole are generally formed in respective separate elements and are connected together during the assembly of the injection valve. The use of these separate elements involves considerable constructional complications and consequent production problems.

The object of the present invention is to avoid these disadvantages and to provide an injection valve of the type defined at the beginning which can be made with a smaller number of components and which is thus cheaper to manufacture and assemble.

According to the invention, this object is achieved by virtue of the fact that the metering solenoid valve with the control chamber, the inlet hole and the discharge hole are integrated in a single element forming a head for the body of the injection valve. This head element may be separate from the body of the injection valve and fixed mechanically thereto or may be integral with the valve body.

In both cases, the inlet hole and the discharge hole may be formed directly by working in the head element or may be formed in inserts housed in this head element.

Figure 1:
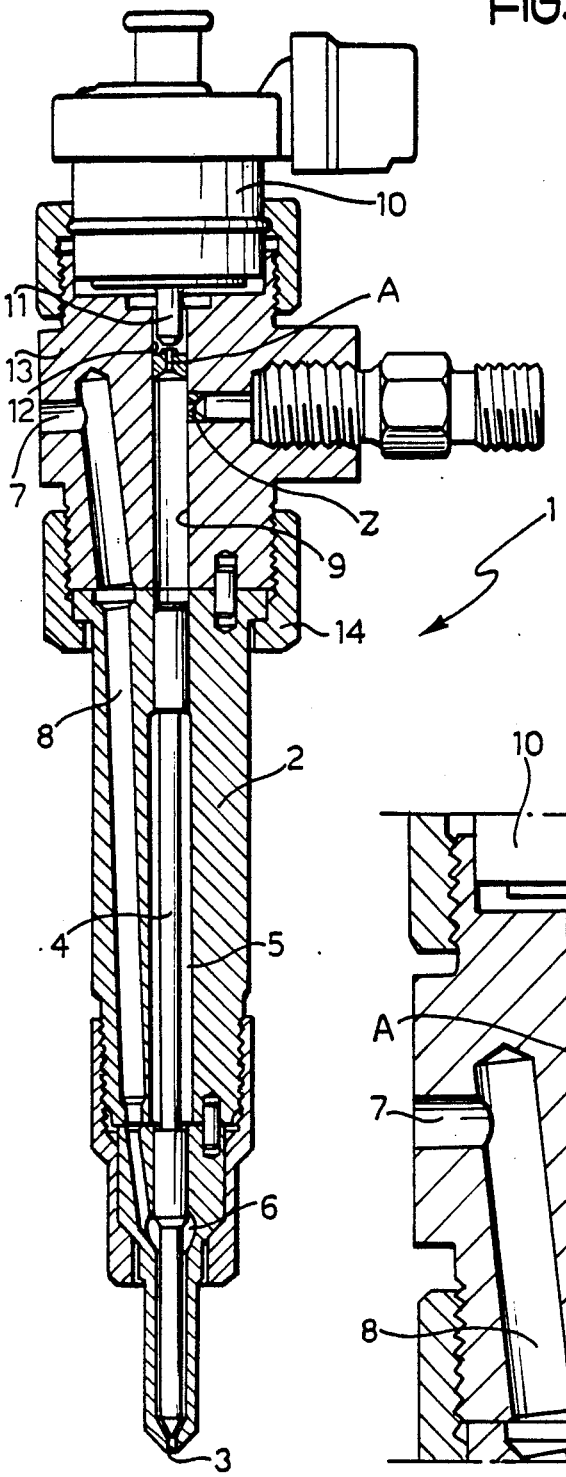
Figure 2:
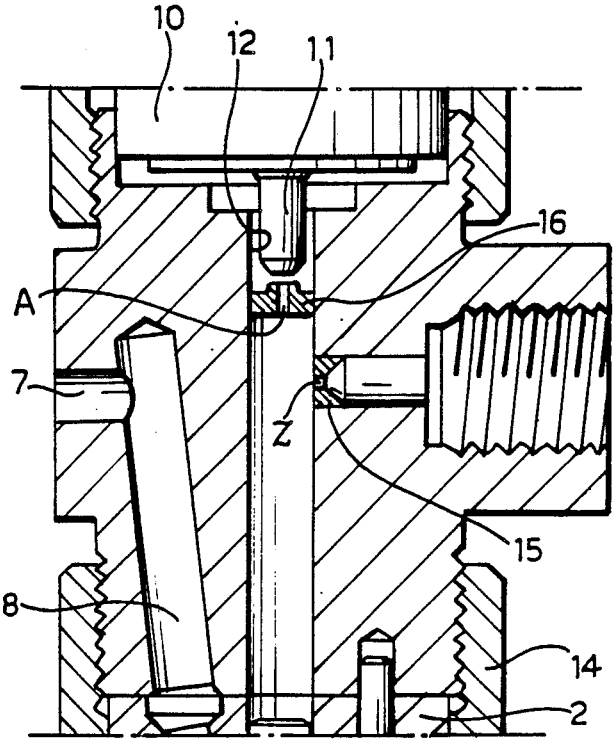

The invention will now be described in detail with reference to the appended drawings, provided purely by way of non-limiting example, in which;

FIG. 1 is a schematic longitudinal sectional view of a fuel injection valve according to the invention, and FIG. 2 shows a variant of FIG. 1.

With reference initially to FIG. 1, a fuel injection valve for diesel engines is generally indicated 1 and comprises essentially a body 2 whose lower end defines an injection nozzle 3 with which a control needle 4 cooperates and is movable axially in a central cavity 5 within the body 2. This cavity 5 forms an injection chamber 6 close to the injection nozzle 3, to which the fuel is supplied under pressure by a pump, not illustrated, from a supply inlet 7 and a passage 8.

The top of the cavity 5 forms a control chamber 9 to which the fuel is also supplied under pressure through an inlet hole Z.

The control chamber 9 is also connected to a discharge through a discharge hole A the opening and closing of which is controlled in known manner by means of an electromagnetically-controlled metering valve 10 the obturator 11 of which is slidable in a guide 12 coaxial with the cavity 5. When the obturator 11 is in its position closing the discharge hole A, the needle 4 is kept in the lowered position to prevent the passage of the pressurised fuel in the injection chamber 6 to the injection nozzle 3. The opening of the discharge hole A by the obturator 11 of the solenoid valve 10 causes a pressure drop in the control chamber 9 and the consequent raising of the needle 4, whereby the pressurised fuel in the injection chamber 6 may be injected through the nozzle 3.

According to the invention, the metering solenoid valve 10 with its guide 12, the control chamber 9, and the inlet hole Z and discharge hole A are integrated in a single common element 13 forming a head for the body 2 of the injection valve 1. In the embodiment illustrated in FIG. 1, the head element 13 is separate from the body 2 of the injection valve 1 and is fixed mechanically thereto, for example, by means of an axial locking ring nut 14.

Alternatively, the head element 13 could be integral with the body 2.

In both cases, the inlet hole Z and the discharge hole A may be formed by working directly in the head element 13 or may be formed in respective inserts 15, 16 housed in the head element 13 in the manner illustrated in FIG. 2.

I claim:

1. An electromagnetically-controlled fuel-injection valve for i.c. engines, comprising:

a body having a lower injection nozzle provided with an injection passage;

a needle movable axially in an elongated cavity of said body and of said nozzle between a first position in which communication is closed between an injection chamber to which fuel is supplied under pressure through a conduit and said injection passage, and a second position in which said communication is open;

a head protruding from an upper part of said body and including an axial hole coaxial with said elongated cavity and in which there is disposed a first insert provided with a discharge hole, and also including a radial hole communicating with said axial hole and in which there is disposed a second insert provided with an inlet hole, said axial hole defining with said inserts and with an upper extremity of said needle a control chamber to which the fuel is supplied under pressure through said radial hole wherein said control chamber does not communicate with said injection chamber; and an electromagnetic metering valve provided with an obturator for controlling passage through said discharge hole to keep the needle in said first and second position respectively when the fuel pressure in said control chamber is respectively greater and lower than a predetermined value, said electromagnetic metering valve being housed in a seat provided on an upper surface of said head and an upper part of said conduit also being located in said head wherein said head is fixed mechanically to said body.

* * * * *

UNITED STATES PATENT AND TRADEMARK OFFICE

CERTIFICATE OF CORRECTION

PATENT NO. : 4,972,997

DATED : November 27, 1990

INVENTOR(S) : Renato FILIPPI

It is certified that error appears in the above-identified patent and that said Letters Patent is hereby corrected as shown below:

On the title page item [73]

Insert:

Assignee: Weber S.r.l.,

Corso Marconi 20

Italy

Signed and Sealed this

First Day of December, 1992

*Attest:*

DOUGLAS B. COMER

*Attesting Officer*

*Acting Commissioner of Patents and Trademarks*